US006494708B1

(12) United States Patent
Hart et al.

(10) Patent No.: US 6,494,708 B1
(45) Date of Patent: Dec. 17, 2002

(54) SAFETY DEVICE FOR CANDLES

(75) Inventors: John Gregory Hart, 2417 Darby Creek Dr., Galloway, OH (US) 43119; Richard N. Rucker, 5250 Goodson Rd., West Jefferson, OH (US) 43162

(73) Assignees: John Gregory Hart, Galloway, OH (US); Richard N. Rucker, West Jefferson, OH (US)

( * ) Notice: Subject to any disclaimer, the term of this patent is extended or adjusted under 35 U.S.C. 154(b) by 112 days.

(21) Appl. No.: 09/758,933

(22) Filed: Jan. 11, 2001

(51) Int. Cl.[7] ..... F23Q 25/00; F21V 25/00

(52) U.S. Cl. ..... 431/33; 431/34; 431/86; 431/146; 431/289

(58) Field of Search ..... 431/33, 34, 35, 431/86, 144, 146, 149, 152, 289, 291, 293; 362/161, 164, 159; 49/29, 30

(56) References Cited

U.S. PATENT DOCUMENTS

| | | | | | |
|---|---|---|---|---|---|
| 312,291 | A | | 2/1885 | Pinel | 431/35 |
| 313,297 | A | * | 3/1885 | Bunnell | 431/86 |
| 587,064 | A | | 7/1897 | Pherson | 431/33 |
| 736,538 | A | | 8/1903 | Newsom | 431/33 |
| 886,198 | A | | 4/1908 | Findlay | 431/35 |
| 897,712 | A | | 9/1908 | Brusseau | 431/33 |
| 1,388,504 | A | | 8/1921 | Baker | 431/33 |
| 2,097,182 | A | * | 10/1937 | Dodge et al. | 362/164 |
| 2,346,455 | A | * | 4/1944 | Russell | 431/152 |
| 2,499,118 | A | * | 2/1950 | Spies | 431/33 |
| 3,905,746 | A | * | 9/1975 | Patrikios | 431/35 |
| 3,998,922 | A | | 12/1976 | Weiss | 264/255 |
| 4,255,117 | A | | 3/1981 | Trotta | 431/34 |
| 5,842,850 | A | * | 12/1998 | Pappas | 431/291 |

FOREIGN PATENT DOCUMENTS

| | | | |
|---|---|---|---|
| JP | 3-8208 A | * | 1/1991 |
| WO | WO 87/03070 A1 | * | 5/1987 |

* cited by examiner

*Primary Examiner*—Henry Bennett
*Assistant Examiner*—Josiah C. Cocks
(74) *Attorney, Agent, or Firm*—Sterne, Kessler, Goldstein & Fox PLLC

(57) ABSTRACT

A method and apparatus is taught for a safety device for a lighted device in a container. The safety device comprises a closing device, an attachment device, and a holding device. The safety device further comprises a coupler configured to operatively couple the closing device, the attachment device, and the holding device so that the closing device moves between a first and second position. There is also an extension coupled to and extending from a surface of the closing device, a securing system coupled to the attachment device, and a timing device coupled to and protruding from a surface of the holding device. Finally, the timing device is operatively configured to interact with the extension when the closing device is in the second position to actuate movement of the closing device into the first position so that the lighted device in the container is extinguished in a predetermined amount of time.

13 Claims, 4 Drawing Sheets

SAFETY DEVICE FOR CANDLES

BACKGROUND OF THE INVENTION

This invention is directed towards safety devices for candles. More particularly, the invention relates to a method and apparatus for automatically actuating candle snuffers and extinguishers.

One of the hottest selling products in today's market are candles. These candles come in all shapes, sizes, colors, scents, and containers. Increasingly, candles are being used to set atmosphere, light rooms, change the smell of a room with fragrances, or the like. Unfortunately, one common feature of all candles is that when left unattended for too long a period of time or disturbed they can cause fires. Recently, there has been a real increase in the frequency, severity, and reporting of fires. The worst cases are when these fires are in apartment houses or social houses since there is an even larger potential for damage to property, and even worse, and increased potential for death.

Manufacturers have recognized this problem and are trying to combat the increasing occurrence of fires caused by candles by producing candles in containers, such as jars or the like. Although this solution has been moderately successful in some ways, there are still fires starting because of unattended or forgotten candles being in these containers or when these candles are disturbed in some fashion. One reason for this is users falsely assumed the candles in containers are safer because of their configuration.

Therefore, a need exists for a safety device for candles in containers that automatically extinguishes a candle in a container after a user selected predetermined duration of time has passed. Further, there is a need for a safety device for candles in containers that can automatically extinguish the candle if the container is disturbed.

SUMMARY OF THE INVENTION

According to the present invention, a method and apparatus is taught for a safety device for a lighted device in a container. The safety device comprises a closing device, an attachment device, and a holding device. The safety device further comprises a coupler configured to operatively couple the closing device, the attachment device, and the holding device so that the closing device moves between a first and second position. There is also an extension coupled to and extending from a surface of the closing device, a securing system coupled to the attachment device, and a timing device coupled to and protruding from a surface of the holding device. Finally, the timing device is operatively configured to interact with the extension when the closing device is in the second position to actuate movement of the closing device into the first position so that the lighted device in the container is extinguished in a predetermined amount of time.

A main advantage of this configuration is that a container containing a candle can automatically be closed, extinguishing the candle, after a user selected predetermined amount of time has elapsed based on the timing device interacting with the extension.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF THE PREFERRED EMBODIMENTS(S)

Figure 1:
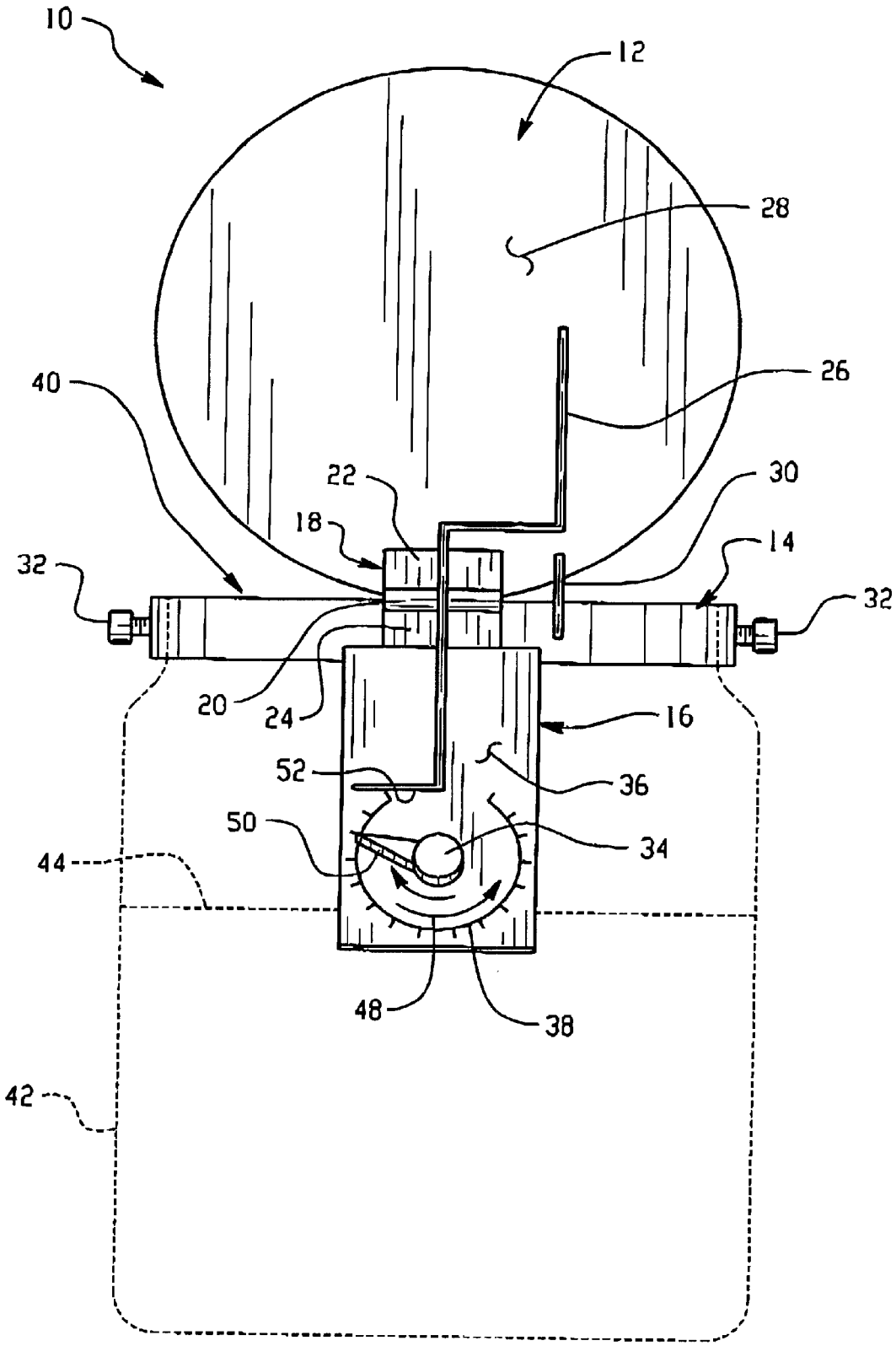
FIG. 1 illustrates a safety device for candles according to a first embodiment of the present invention.

As seen in FIG. 1, an apparatus 10 according to a first embodiment of the present invention is shown. Preferably, the apparatus 10 is a safety device for candles. The apparatus includes a first section 12, a second section 14, and a third section 16. Preferably, the first section 12 is a closing device, e.g., a lid, the second section 14 is a an attachment device, e.g., a rim device or ring device, and the third section 16 is a holding device. The apparatus 10 further comprises a coupler 18 that is configured to operatively couple the first through third sections 12–16, respectively, so that the first through third sections 12–16, respectively, move relative to one another. Preferably, the coupler 18 is a hinge or flexible type device. In a preferred configuration, the center portion 20 of the coupler 18 is coupled to the second section 14, a first end portion 22 of the coupler 18 is coupled to the first section 12, and a second end portion 24 of the coupler 18 is coupled to the third section 16.

It is to be appreciated that the first and second sections 12 and 14, respectively, could be made of similar non-flammable material, such as metal, aluminum, alloy, molded plastic, or the like. Also, the third section 16 can be made of any non-flammable material, such as metal, aluminum, alloy, molted plastic, or the like. Further, the coupler 18 can be coupled to the first through third sections 12–16, respectively, with any known material, such as adhesive material or small screws, bolts, or the like.

With continuing reference to FIG. 1, the first section 12 comprises an extension 26 coupled to and extending from a surface 28 and an optional second extension 30 coupled to and extending from the surface 28. The second extension 30 is preferably a stopping device that stops the movement of the closing device 12 as it moves from a first position, e.g., closed, to a second position, e.g., opened a predetermined amount. The second section 14 includes a securing system 32. The securing system 32 is preferably a set of threaded devices that interact with threaded openings (not shown) in the second section 14. It is to be appreciated, alternative embodiments comprise similar functioning securing systems, such as a clasp or spring loaded securing device or a malleable device, e.g., a soft rubber like material, that allows the second section 14 to be secured through form fitting and friction. The third section 16 comprises a timing device 34 coupled to and protruding from a surface 36 and a scale 38 on the surface 36. Preferably, the timing device 34 is a mechanical timer, e.g., a kitchen timer or the like.

Figure 2:
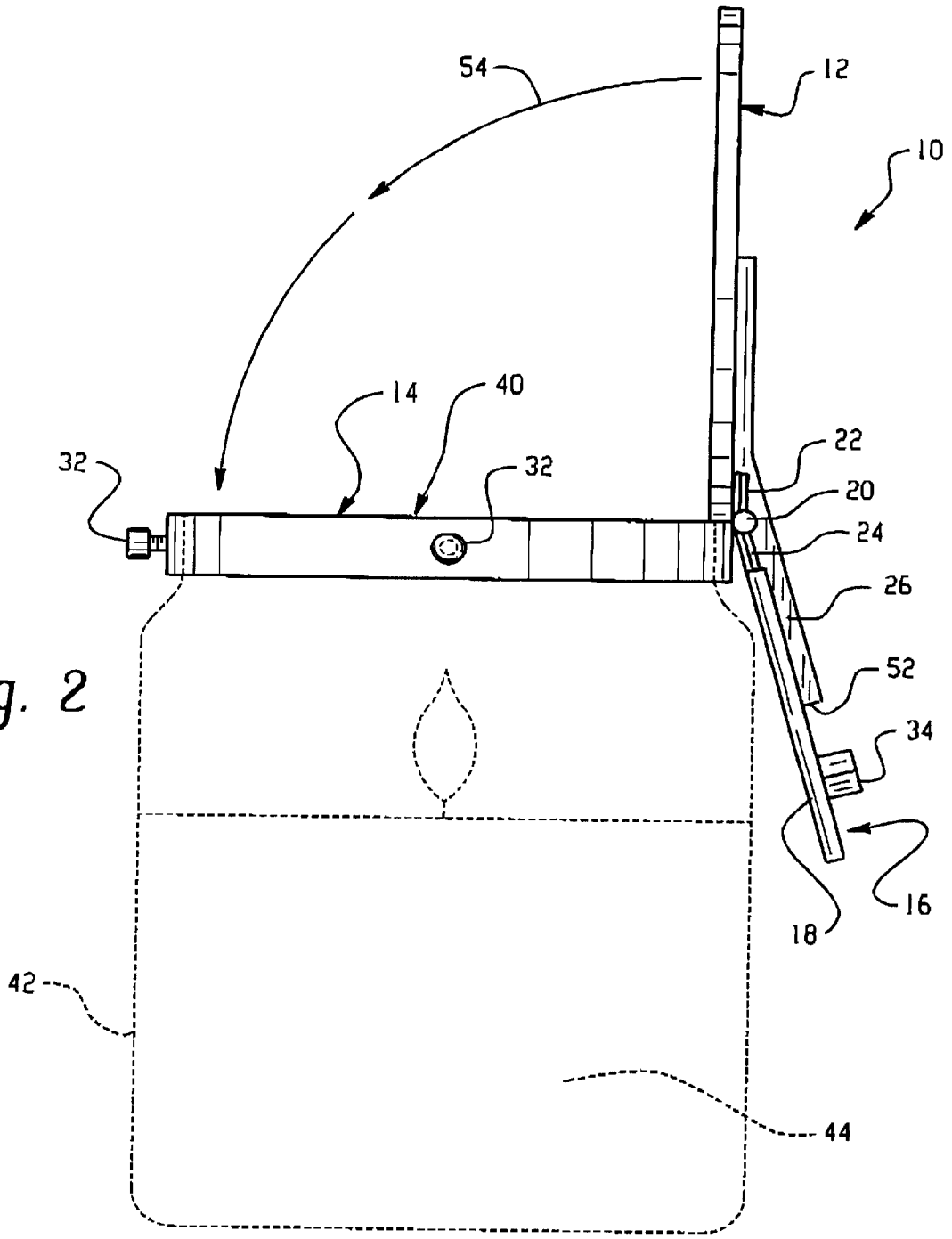
FIG. 2 illustrate a side view of the safety device for candles in FIG. 1.
Figure 3:
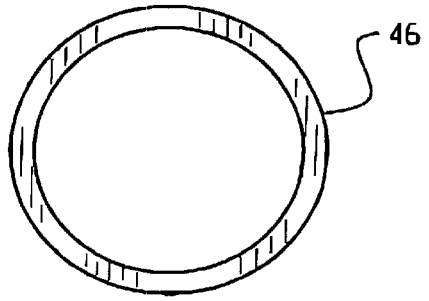
FIG. 3 illustrates a portion of a height adjusting device section of the safety device for candles in FIG. 1.

With further reference to FIG. 1, and reference to FIG. 2, in a preferred embodiment the apparatus 10 is secured adjacent an opening 40 of a container 42. Also, the container 42 comprises a lighted device 44, preferably a candle or the like. The container 42 and candle 44 are represented as dashed lines in FIG. 1. As seen in FIG. 3, a position adjusting device 46, or a plurality of position adjusting devices 46, may be positioned between an inside surface of the second section 14 and the opening 40 of the container 42 to fine adjust a position of the second device 14 until an optimal secured position is found. Preferably, the position adjusting device 46 is utilized when the opening 40 is much smaller than the second section 14. At that time a user can secure the apparatus 10 onto the container 42 with the securing system 32.

A preferred operation of the apparatus 10 with reference to FIGS. 1–2 will now be described after the apparatus 10 has been secured to container 42. A user will lift the first section 12 from the first position, e.g., closed, to the second position, e.g., opened a predetermined amount. In a preferred embodiment the second position cannot be attained unless the timing device 34 has been moved in the direction of arrow 48, e.g., counter-clockwise, to an ON position that starts the timing device 34 on a user selected predetermined duration of time. Once the first section 12 is placed in the second position the user can ignite the candle 44. During the duration of time on the timing device 34, determined by the scale 38, air can flow into the container 42 through the opening 40 based on the first section 12 being in the second position. Once the duration of time ends, the timing device 34 will return to an OFF position and a tip portion 50 of the timing device 34 interacts with an end portion 52 of the extension 26 forcing the extension 26 upward. This force causes the first section 12 to move in the direction of arrow 54 returning the first section 12 to the first position. Once the first section 12 is in the first position the lack of air entering the container 42 will extinguish the lighted device 44 in a predetermined amount of time. Preferably, the predetermined amount of time is around 5 seconds. In an alternative embodiment, if during the duration of time a user or someone else disturbs the container or a structure holding the container, e.g., a table or the like, a predetermined amount, the first section 12 will automatically close, which extinguishes the lighted device 44 in the predetermined amount of time.

Therefore, through a preferred arrangement of the apparatus 10 the candle 44 is automatically extinguished after a user selected predetermined duration of time. Thus, a user or a parent, friend, or relative of the user, can gain increased peace of mind when the user wants to light a candle. Further, the arrangement of apparatus 10 will also automatically extinguish the candle 44 when a predetermined amount of disturbance occurs around the candle 44 as an added measure of safety.

Figure 4:
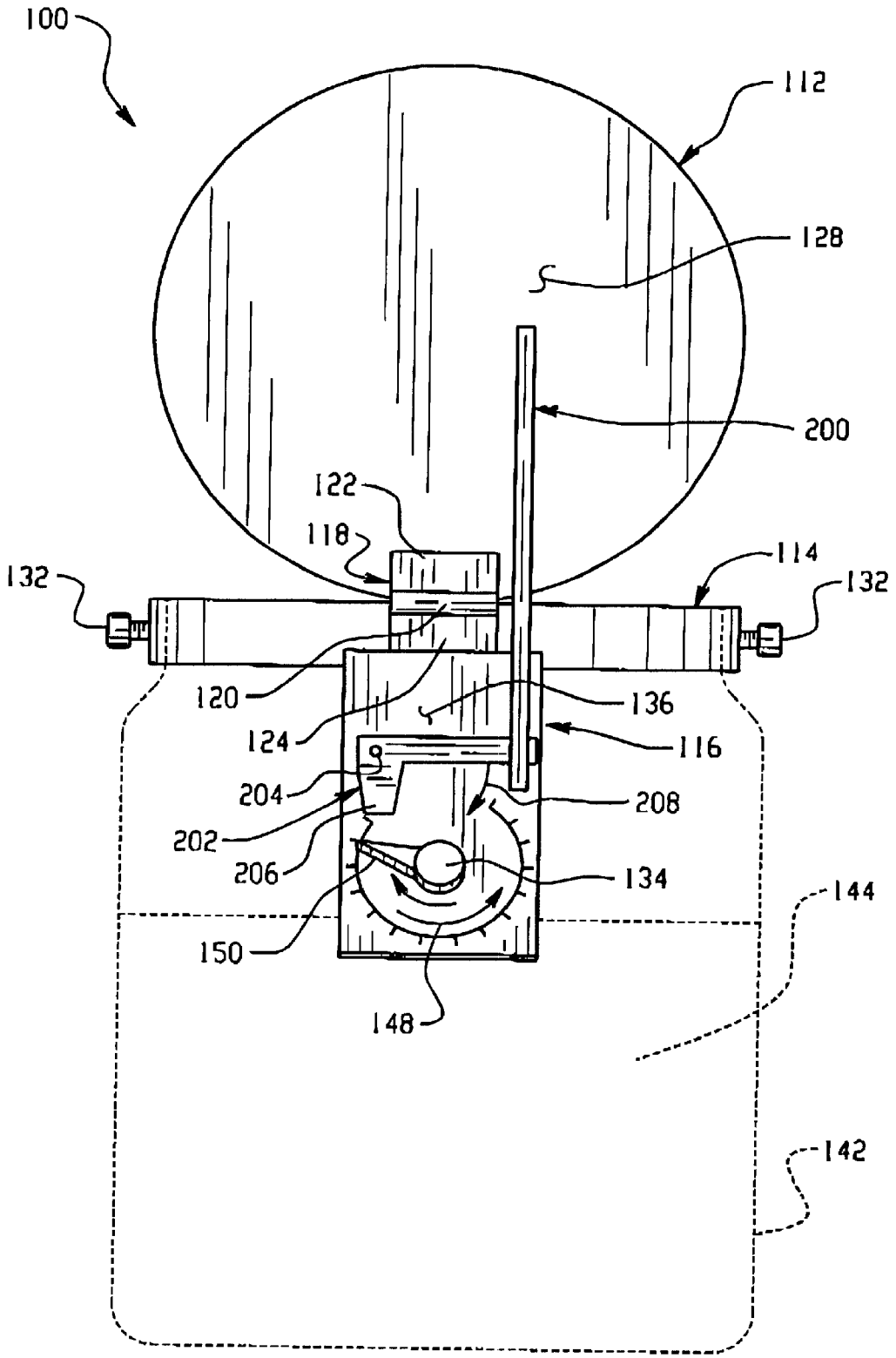
FIG. 4 illustrates a safety device for candles according to a second embodiment of the present invention.

Turing now to FIG. 4, an apparatus 100 according to a second embodiment of the present invention is shown. Throughout the description of FIG. 4, all elements similar to the apparatus 10 in FIGS. 1–2 will have similar elements numbers with a 100 prefix. For example, apparatus 100 in FIG. 4 for apparatus 10 in FIGS. 1–2, first section 112 in FIG. 4 for first section 12 in FIGS. 1–2. These similar elements function similarly to the elements in the previous description, so the description will not be repeated for convenience.

A main difference in the second embodiment shown in FIG. 4 is the shape and interaction of an extension 200 coupled to and extending from a surface 128 of a first section 112 and the addition of a holding device 202 that holds the extension 200 when the first section 112 is in the second position. In this embodiment, the holding device 202 pivots around pivot securing device 204. Thus, in operation an end portion 150 of a timing device 134 will interact with an end portion 206 of the holding device 202 when the duration of time has elapsed and the timing device 134 is in an OFF position. Next, the holding device 202 will pivot in the direction of an arrow 208 to release the extension 200 allowing the first section 112 to return to the first position. Finally, once the first section 112 returns to the first position, the candle 144 is extinguished in a predetermined amount of time since no air can enter the container 142.

It is to be appreciated the container 42 might contain reflective surfaces, or in other alternative embodiments the first section 12 can include reflective surfaces. These reflective surfaces would be utilized to enhance the light produced by the candle 44.

Figure 5A:
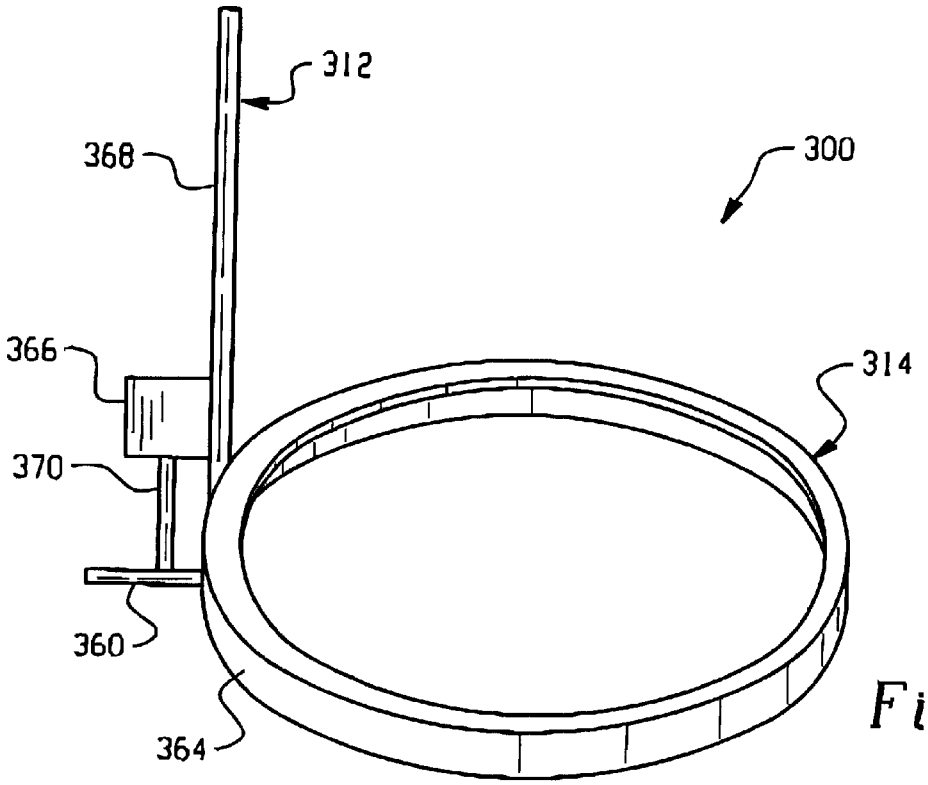
FIGS. 5A and 5B illustrating a safety device for candles according to a third and fourth embodiment, respectively, or the present invention.
Figure 5B:
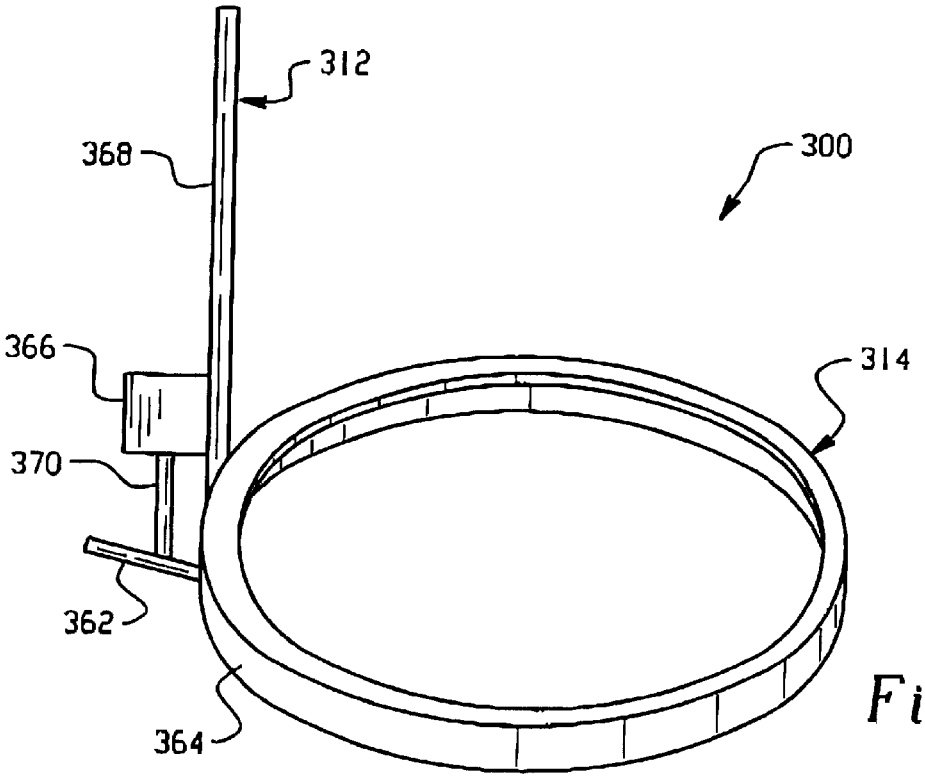

Now with reference to FIGS. 5A and 5B, again similar elements will have similar numbers with a 300 prefix. These figures show an apparatus 300 according to third and fourth embodiments of the present invention. The apparatus 300 comprises a first section 312 and a second section 314. A main difference between the first two embodiments in FIGS. 1–4 and these second two embodiments is that an extension 360 in FIG. 5A and extension 362 in FIG. 5B extends from an outside edge surface 364 of the second section 314. The extension 360 or 362 in alternative embodiments can be either stationary or moveable. Also, the extension 360 is substantially horizontal, while the extension 362 is at a predetermined angle. Another main difference is that a timing device 366, preferably an electronic timing device, is coupled to and protrudes from an outside surface 368 of the first section 312. The timing device 366 comprises an extension 370 that extends to a first position, e.g., a contacting position, and retracts to a second position, e.g., a non-contacting position. The timing device 366 is configured to automatically extend the extension 370 when a user selected predetermined time duration has expired and retract the extension 370 either automatically or through manual manipulation after the first section 312 is in the first position, e.g., closed.

In operation, a user will set a predetermined duration of time on the timing device 366 after moving the first section 412 from the first position, e.g., closed, to the second position, e.g., opened a predetermined amount. Once the selected predetermined duration of time has elapsed, the timing device 366 is configured to automatically extend the extension 370 until contact is made with the extension 362. The force caused by the contact is enough to initiate movement of the first section 312 to return the first section 312 to the first position. By having the extension 362 extending at a predetermined angle less force is needed to return the first section 312 to the first position. The other functions as described above for embodiments one and two also are performed by the apparatus 300 in embodiments three and four.

From the above description of the invention, those skilled in the art will perceive improvements, changes and modifications in the invention. Such improvements, changes and modifications within the skill of the art are intended to be covered.

We claim:

1. A safety device for a lighted device in a container, the safety device comprising:

a closing device;

a ring-shaped attachment device that is removably coupled to the container;

a holding device;

a coupler configured to operatively couple the closing device, the attachment device, and the holding device so that the closing device moves between a first and second position;

an extension coupled to and extending from a surface of the closing device;

a securing system coupled to the ring-shaped attachment device; and a timing device coupled to and protruding from a surface of the holding device and the timing device is operatively configured to interact with the extension when the closing device is in the second position to actuate movement of the closing device into the first position so that the lighted device in the container is extinguished in a predetermined amount of time.

2. The safety device in claim 1, wherein the timing device is operatively configured to stop the closing device from reaching the second position unless the timing device is in an ON position.

3. The safety device in claim 1, wherein:

the lighted device is a candle; and the container is a glass jar;

wherein the ring-shaped attachment device is configured to be secured onto an opening of the glass jar.

4. The safety device of claim 3, wherein a position adjustment device is coupled to an inside surface of the ring-shaped attachment device before securing the ring-shaped attachment device to the jar to adjust a position of the securing system.

5. The safety device of claim 1 wherein the lighted device is extinguished in five seconds.

6. The safety device of claim 1 wherein the holding device further includes a rotatingly attached bar configured to interact with the extension so that the closing device is held securely in the second position until the timing device reaches an OFF position, wherein the timing device actuates movement of the bar to release the extension causing the closing device to move to the first position.

7. The safety device of claim 1 wherein the closing device is operatively configured to move to the first position if the container is disturbed a predetermined amount.

8. A method comprising the steps of:

removably securing a ring-shaped attachment device of an apparatus to a container containing a lighted device;

turning ON a timing device on a first section of the apparatus so that an extension from a second section of the apparatus extends adjacent an OFF position of the timing device when the second section is in a first position; and automatically moving the second section of the apparatus to a first position when the timing device reaches an OFF position based on an interaction of a portion of the timing device with the extension, such that when the second section of the apparatus is in the first position the second section is configured to operatively extinguish the lighted device in a predetermined amount of time.

9. A method according to claim 8, further comprising the step of automatically moving the second section to the first position when the container is disturbed a predetermined amount.

10. A safety device for a lighted device in a container, the safety device comprising:

a closing device;

an attachment device shaped to fit around an opening of the container, the attachment device including a securing system that removably secures the attachment device around the opening of the container;

a holding device;

a coupler configured to operatively couple the closing device, the attachment device, and the holding device so that the closing device moves between a first and second position;

an extension coupled to and extending from a surface of the closing device; and a timing device coupled to and protruding from a surface of the holding device and the timing device is operatively configured to interact with the extension when the closing device is in the second position to actuate movement of the closing device into the first position so that the lighted device in the container is extinguished in a predetermined amount of time.

11. The safety device of claim 10, wherein the securing device is a set of screws that pass through openings in the attachment device, wherein the screws interact with the container adjacent the opening of the container.

12. The safety device of claim 10, wherein the securing device is a clamping device that clamps the attachment device to the container adjacent the opening of the container.

13. The safety device of claim 10, wherein the securing device is a form fitting device that couples to the opening of the container.

* * * * *